US011215036B2

(12) United States Patent
Hammer et al.

(10) Patent No.: US 11,215,036 B2
(45) Date of Patent: Jan. 4, 2022

(54) COMPLETION SYSTEMS WITH A BI-DIRECTIONAL TELEMETRY SYSTEM

(71) Applicants: Aaron C. Hammer, Houston, TX (US); Robert S. O'Brien, Katy, TX (US)

(72) Inventors: Aaron C. Hammer, Houston, TX (US); Robert S. O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 139 days.

(21) Appl. No.: 15/221,183

(22) Filed: Jul. 27, 2016

(65) Prior Publication Data

US 2016/0348481 A1 Dec. 1, 2016

Related U.S. Application Data

(63) Continuation of application No. 14/133,122, filed on Dec. 18, 2013, now Pat. No. 9,416,653.

(51) Int. Cl.

| | |
|---|---|
| ***E21B 43/04*** | (2006.01) |
| ***E21B 47/002*** | (2012.01) |
| ***E21B 47/07*** | (2012.01) |
| ***E21B 47/12*** | (2012.01) |
| ***E21B 17/00*** | (2006.01) |

(Continued)

(52) U.S. Cl.

CPC ..... *E21B 43/045* (2013.01); *E21B 17/003* (2013.01); *E21B 23/06* (2013.01); *E21B 34/06* (2013.01); *E21B 43/08* (2013.01); *E21B 43/14* (2013.01); *E21B 43/26* (2013.01); *E21B 47/002* (2020.05); *E21B 47/06* (2013.01); *E21B 47/07* (2020.05); *E21B 47/12* (2013.01);

(Continued)

(58) Field of Classification Search

CPC ..... E21B 17/003; E21B 43/045; E21B 47/07; E21B 47/002; E21B 47/06; E21B 47/12; E21B 47/16; E21B 23/06; E21B 34/06; E21B 43/14; E21B 43/26; E21B 49/08; E21B 2200/06

See application file for complete search history.

(56) References Cited

U.S. PATENT DOCUMENTS

2003/0221829 A1* 12/2003 Patel ..... A45C 13/02 166/278
2007/0235185 A1* 10/2007 Patel ..... E21B 43/04 166/250.01

(Continued)

FOREIGN PATENT DOCUMENTS

WO 2009076014 A3 6/2009

*Primary Examiner* — Dany E Akakpo
(74) *Attorney, Agent, or Firm* — Cantor Colburn LLP

(57) ABSTRACT

An apparatus for use in a wellbore for performing a treatment operation is disclosed that in one non-limiting embodiment may include an inner string that further includes a first tubular having a first communication link, and a service tool including a cross-over tool having a fluid flow passage therein for supplying a treatment fluid under pressure from an inside of the service tool to an outside of the service tool, and wherein the service tool includes a second communication link operatively coupled to the first communication link and wherein the second communication link runs across or through the fluid flow passage in the cross-over tool that is protected from direct flow of the fluid under pressure from the inside of the service tool to the outside of the service tool.

17 Claims, 6 Drawing Sheets

(51) Int. Cl.

| | |
|---|---|
| ***E21B 23/06*** | (2006.01) |
| ***E21B 34/06*** | (2006.01) |
| ***E21B 43/08*** | (2006.01) |
| ***E21B 43/14*** | (2006.01) |
| ***E21B 43/26*** | (2006.01) |
| ***E21B 47/06*** | (2012.01) |
| ***E21B 47/16*** | (2006.01) |
| ***E21B 49/08*** | (2006.01) |

(52) U.S. Cl.
CPC ..... *E21B 47/16* (2013.01); *E21B 49/08* (2013.01); *E21B 2200/06* (2020.05)

(56) References Cited

U.S. PATENT DOCUMENTS

| | | | | |
|---|---|---|---|---|
| 2009/0255667 | A1* | 10/2009 | Clem | E21B 43/045 166/242.4 |
| 2009/0294137 | A1* | 12/2009 | Meijer | E21B 33/1295 166/387 |
| 2011/0042061 | A1* | 2/2011 | Martin | E21B 47/00 166/51 |
| 2011/0042064 | A1 | 2/2011 | Martin et al. | |
| 2011/0241897 | A1* | 10/2011 | Haynes | E21B 47/12 340/854.5 |
| 2012/0043079 | A1 | 2/2012 | Wassouf et al. | |

* cited by examiner

COMPLETION SYSTEMS WITH A BI-DIRECTIONAL TELEMETRY SYSTEM

CROSS REFERENCE TO RELATED APPLICATIONS

The present disclosure is a continuation of U.S. application Ser. No. 14/133,122, filed on Dec. 18, 2013, the contents of which are incorporated herein by reference in its entirety.

BACKGROUND

1. Field of the Disclosure

This disclosure relates generally to apparatus and methods for completing a wellbore for the production of hydrocarbons from subsurface formations, including fracturing, gravel packing and flooding selected zones and for communicating information in real-time about various downhole operations.

2. Background of the Art

Wellbores are drilled in subsurface formations for the production of hydrocarbons (oil and gas). Modern wells can extend to great well depths, often more than 6000 meters (about 20,000 ft.). Hydrocarbons are trapped in various traps in the subsurface formations at different depths. Such sections of the formation are referred to as reservoirs or hydrocarbon-bearing formations or zones. Some formations have high mobility, a measure of the ease of the hydrocarbons flow from the reservoir into a well drilled through the reservoir under natural downhole pressures. Other formations possess low mobility and the hydrocarbons trapped therein are unable to move with ease from the reservoir into the well. Stimulation methods are typically employed to improve the mobility of the hydrocarbons through the reservoirs. One such method, referred to as fracturing (also referred to as "fracing" or "fracking"), is often utilized to create cracks in the reservoir to enable the fluid from the formation (formation fluid) to flow from the reservoir into the wellbore. To sand control, frac-pacing and gravel packing multiple zones, an assembly containing an outer string with an inner string therein is run in or deployed in the wellbore. The outer string is conveyed in the wellbore with a tubing attached to its upper end and it includes various devices corresponding to each zone to be fractured for supplying a fluid with proppant to each such zone. The inner string (also referred to as the "service string") includes devices or tools attached to a tubing (which tubing can extend over 1,000 meters (about 3,000 feet) to perform a number of operations during treatment or service operations, including, but not limited to, setting an upper packer with a packer setting tool, setting a tool at selected locations of the outer string, setting packers, opening and closing valves, flowing fracture fluid from the inner string into the production zones via a frac port, and performing reverse flow and return flow operations. In such systems, It is desirable to obtain real-time information about the various operations performed in a wellbore using the inner string and outer string, including determining location of a device or element downhole, setting a device, fluid flow, temperature and pressure profiles, quality of the performed operations, etc. from various location along the inner string, including locations below the frac port. However, commercially utilized inner strings that include a packer setting tool and frac port are not available with a control line or communication link that runs from the surface to a location below the frac.

The disclosure herein provides systems and methods for use in wellbore operations that include a two-way communication system for providing real-time information between a surface location and downhole devices and operations, including information from locations below the frac port.

SUMMARY

In one aspect, an apparatus for use in a wellbore for performing a treatment operation is disclosed that in one non-limiting embodiment may include an inner string that further includes a first tubular having a first communication link, and a service tool including a cross-over tool having a fluid flow passage therein for supplying a treatment fluid under pressure from an inside of the service tool to an outside of the service tool, and wherein the service tool includes a second communication link operatively coupled to the first communication link and wherein the second communication link runs across or through a through passage in the cross-over tool that is protected from direct flow of the fluid under pressure from the inside of the service tool to the outside of the service tool.

In another aspect, a method of performing a treatment operation in a wellbore is disclosed that in one non-limiting embodiment may include: providing an outer string; providing an inner string for placement inside the outer string, wherein the inner string includes a cross-over tool for supplying fluid under pressure from the inner string to the outer string; and running a communication link across or through the crossover tool that is protected from direct flow of the fluid from the inner string to the outer string through the cross-over tool.

Examples of the more important features of a well treatment system and methods that have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
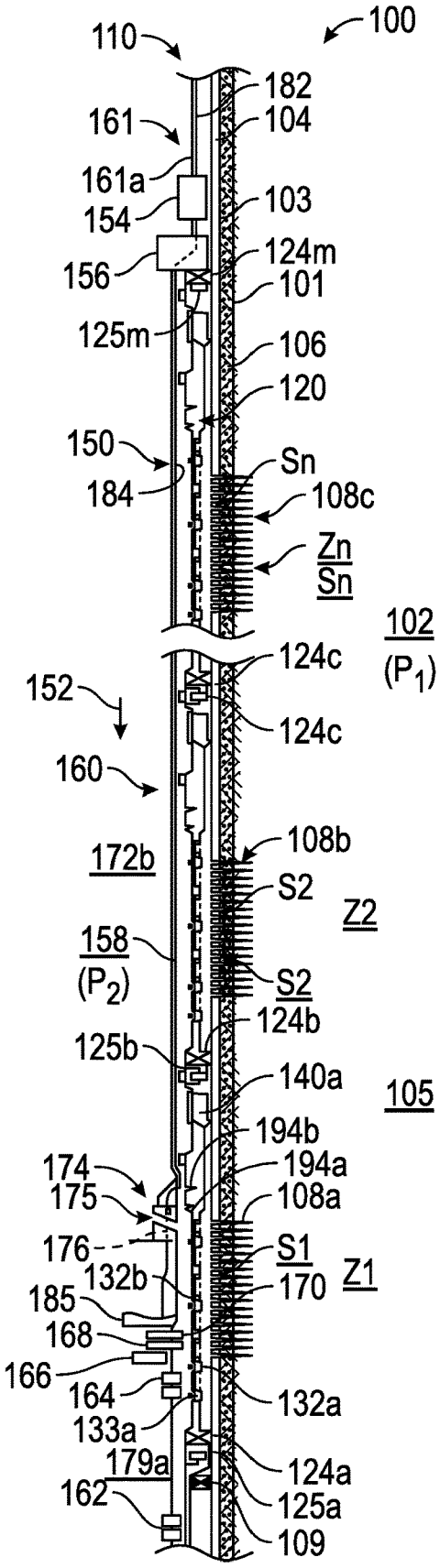
FIG. 1 shows an exemplary cased hole multi-zone wellbore system configured for a well treatment operation such as frac-packing. The wellbore system is shown to include a wellbore that has been lined with a casing

FIG. 1 is a line diagram of a section of an exemplary multi-zone wellbore system 100 that is shown to include a wellbore 101 formed in formation 102 for performing a treatment operation therein, such as fracturing the formation (also referred to herein as fracing or fracking), frac-packing, gravel packing, etc. and for determining, in real time or near real time, parameters of interest relating to such operations from sensors deployed in the system 100 and taking actions in response to such determined parameters of interest. The wellbore 101 is lined with a casing 104, such as a string of jointed metal pipe sections, known in the art. The space or annulus 103 between the casing 104 and the wellbore 101 is filled with cement 106. The system 100 is described herein in reference to a cased-hole; however, the concepts, apparatus and methods as described herein or with obvious modifications may equally be utilized for open holes. The particular embodiment of FIG. 1 is shown for selectively treating one or more zones in any selected sequence or order. However, wellbore 101 may be configured to perform other treatment or service operations, including, but not limited to, gravel packing and flooding a selected zone to move fluid in the zone toward a production well (not shown). The formation 102 is shown to include multiple zones Z1-Zn (also referred to as production zones) which may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 to include perforations 108*b*, and Zone includes Zn to include perforations 108*n*. The perforations provide fluid passages for fracturing corresponding zones. The perforations also provide fluid passages for formation fluid 150 to flow from the formation 102 to the casing 104. The wellbore 101 includes a sump packer 109 proximate to the bottom 101*a* of the wellbore 101. [open hole mentioned in paragraph 0009 below]

After casing, cementing, sump packer deployment, perforating and cleanup operations, the wellbore 101 is ready for treatment operations. Although system 100 is described in reference to fracturing and gravel packing production zones, the concepts, apparatus and methods as described herein or with obvious modifications may also be utilized for other well treatment operations, including, but not limited to, fracturing and gravel packing. Furthermore, the concepts, apparatus and methods disclosed herein may equally be utilized for open hole applications. The formation fluid 105 is at the formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 105 from the formation 102 into the casing 104 and prevents blow-outs.

Still referring to FIG. 1, to fracture (treat) one or more zones Z1-Zn, a system assembly 110 is deployed in the wellbore 101, which includes an outer string 120 and an inner string 160 placed inside the outer string 120. The outer string 120 includes a pipe 122 and a number of devices associated with each of the zones Z1-Zn for performing treatment operations. In one non-limiting embodiment, the outer string 120 includes a lower packer 124*a*, an upper packer 124*m* and intermediate packers, such as packer 124*b*. The lower packer 124*a* isolates the sump packer 109 from hydraulic pressure exerted in the outer string 120 during fracturing and sand packing of the production zones Z1-Zn. In one aspect, packers 124*a*-124*m* may be hydraulically set or deployed packers. In another aspect, packers 124*a*-124*m* may be mechanically set or deployed. Still referring to FIG. 1, the outer string 120 further includes a screen adjacent to each zone Z1-Zn. For example, screen S1 is shown placed adjacent to zone Z1, screen S2 adjacent zone Z2 and screen Sn adjacent to zone Zn. The lower packer 124*a* and intermediate packer 124*b* are deployed to isolate zone Z1 from the remaining zones. Other zones are similarly isolated for treatment operations. Each packer has an associated packer setting or activation device, such as packer setting device 125*a* for packer 124*a*, packer setting device 125*b* for packer 124*b* and packer setting device 125*m* for packer 124*m*. In the case of a hydraulically-activated packer, any suitable device known in the art, including a piston device, may be utilized as the hydraulic activation device, and in case of a mechanically-activated packer, the device may include a mechanical member that is moved to set the packer.

In one aspect, each screen has one or more associated flow control devices, such as sliding sleeve valves 132*a* and 132*b* shown on screen S1. Other screens have similar devices. The outer string 120 also includes, for each zone, a flow control device, referred to as the slurry outlet or a gravel exit, such as a sliding sleeve valve or another valve, uphole or above its corresponding screen to provide fluid communication between the inside 120*a* of the outer string 120 and its corresponding zone. FIG. 1 shows an exemplary slurry outlet 140*a* for zone Z1 between screen S1 and the intermediate packer 124*b*.

Still referring to FIG. 1, the inner string 160 includes an upper section 160*a* that includes a tubular 161 made by joining pipe sections (such as drill pipe) and a lower section 150 (referred to as the service tool) connected to the upper section 160*a*. The service tool 150 includes a pipe or tubular 158, which may be a flush joint tubular, known in the art. The service tool 150 also may include an interface sub 154 attached to the bottom end 161*a* of the tubular 161 to provide a connection for a communication link 182 in the tubular 161 to a communication link or line 184 in the service tool 150, as described in more detail in reference to FIGS. 2-5. The phrase "communication link" or "communication line" means a link for communicating signals, data and/or power from one location to another. The communication link may be any suitable link, including, but not limited to, electric lines, fiber optic lines and other links, such as acoustic links or a combination of such links.

Still referring to FIG. 1, the service tool 150 includes a packer setting tool 156 for setting the upper packer 124*m*. In a multi-zone well system, the tubular 158 may extend to over 3,000 feet. The service tool 150 further includes an opening shifting tool 162 and a closing shifting tool 164 along the lower end 160*a* of the inner string 160. The inner string 160 further may include a reversing valve 166 that facilitates the removal of treatment fluid from the wellbore after treating each zone, and an up-strain locating tool 168 for locating one or more locations uphole of a set-down location, such as a locations 194*b* for zone Z1 when the inner string 160 is pulled uphole, and a set down tool or set down locating tool 170. In one aspect, the set down tool 170 may be configured to locate each zone and then set down the inner string 160 at each such location for performing a treatment operation. The service tool 150 further includes a cross-over tool 174 (also referred to herein as the "frac port") for providing a fluid path 175 between the inner string 160 and the outer string 120. In one aspect, the frac port 174 also includes flow passages 176 therethrough, which passages may be gun-drilled through the frac port 174 to provide fluid communication between space 172*a* below the frac port 174 and space 172*b* above the frac port 174. The size of passages 176, however, are sufficient to provide fluid flow and thus pressure communication between spaces 172*a* and 172*b*.

To perform a treatment operation in a particular zone, for example zone Z1, lower packer 124*a* and upper packer 124*m* are set or deployed. Setting the upper packer 124*m* and lower packer 124*a* anchors the outer string 120 inside the casing 104. The production zone Z1 is then isolated from all the other zones. To isolate zone Z1 from the remaining zones Z2-Zn, the inner string 160 is manipulated to cause the opening tool 164 to open a monitoring valve 133*a* in screen S1. The inner string 160 is then manipulated (moved up and/or down) inside the outer string 120 so that up-strain locating tool 168 locates a profile 194*b*. The set down tool 170 is then manipulated to cause it to set down in the set down profile 194*a*. When the set down tool 170 is set down at location 194*a*, the frac port 174 is adjacent to the slurry outlet 140*a*. The packer 124*b* is then set to isolate zone Z1. Once the packer 124*b* has been set, frac sleeve 140*a* is opened to supply slurry or another fluid to zone Z1 to perform a fracturing or a treatment operation. Once zone Z1 has been treated, the treatment fluid in the wellbore is removed by closing the reversing valve 166 to provide a fluid path from the surface in the space (or annulus) between the outer string 120 and the inner string 160 so that a fluid supplied from the surface into such annulus will cause the treatment fluid to move to the surface, which process is referred to as reverse circulation or reversing. After reverse circulation, the inner string 160 may then be moved to set down device 170 at another zone for treatment operations.

Still referring to FIG. 1, as described earlier, the inner string 160 includes a control line, also referred as the "communication link" for providing communication between a location in the service tool and the surface. The phrase "control line" or "communication link" means a link for communicating signals, data and/or power from one location to another. In one non-limiting embodiment, a communication link 182, which may be a conductor, runs through the tubular 161, referred to as the wired pipe in the art. Interface sub 154 connects the communication link 182 to a communication link 184 associated with the service tool 150 that runs to a control circuit 185 below the cross-over tool 174. In one non-limiting embodiment, the communication link 184 passes through the packer setting tool 156, as described in more detail in reference to FIG. 2. The communication link 184 then runs along the tubing 158 and then through the cross-over tool 174, as described in more detail in reference to FIGS. 3 and 4. The communication link 184 then may pass other devices, such as the set down locating tool 170, the up-strain locating tool 168, reversing valve 166 and then along the tubing 158 below such devices. The control circuit 185 may be placed at any suitable location in the communication link 184 to receive signals from various sensors placed in the casing 104, outer string 120 and the inner string 160, as described in more detail in reference to FIG. 5. An exemplary packer setting tool 200 and a manner for running the communication link 184 through such a packer is described below in reference to FIG. 2.

Figure 2:
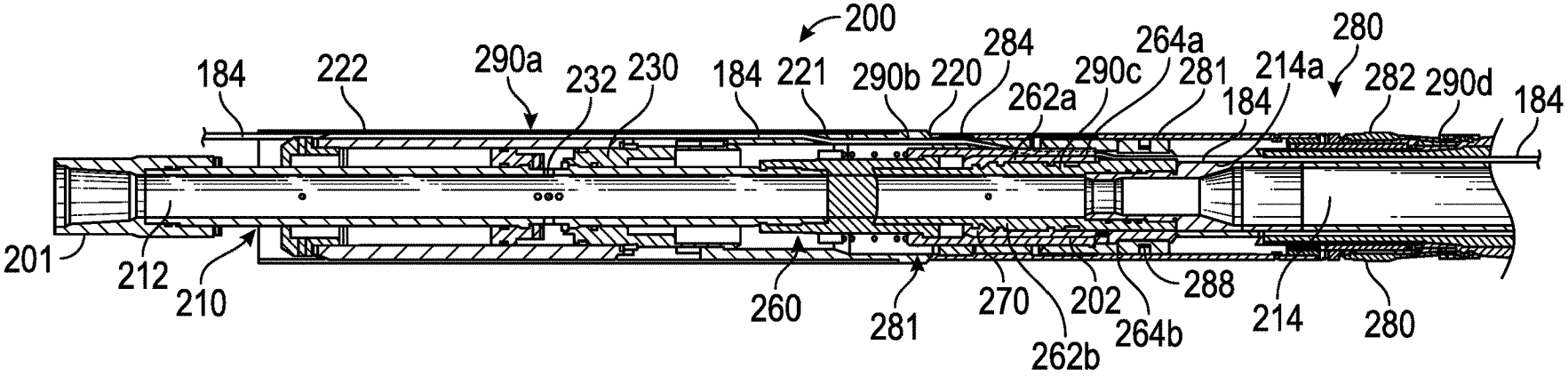
FIG. 2 shows certain details of an exemplary embodiment of the packer setting tool shown in FIG. 1 with the routing of the control line there through, according to one non-limiting embodiment of the disclosure.
Figure 2A:
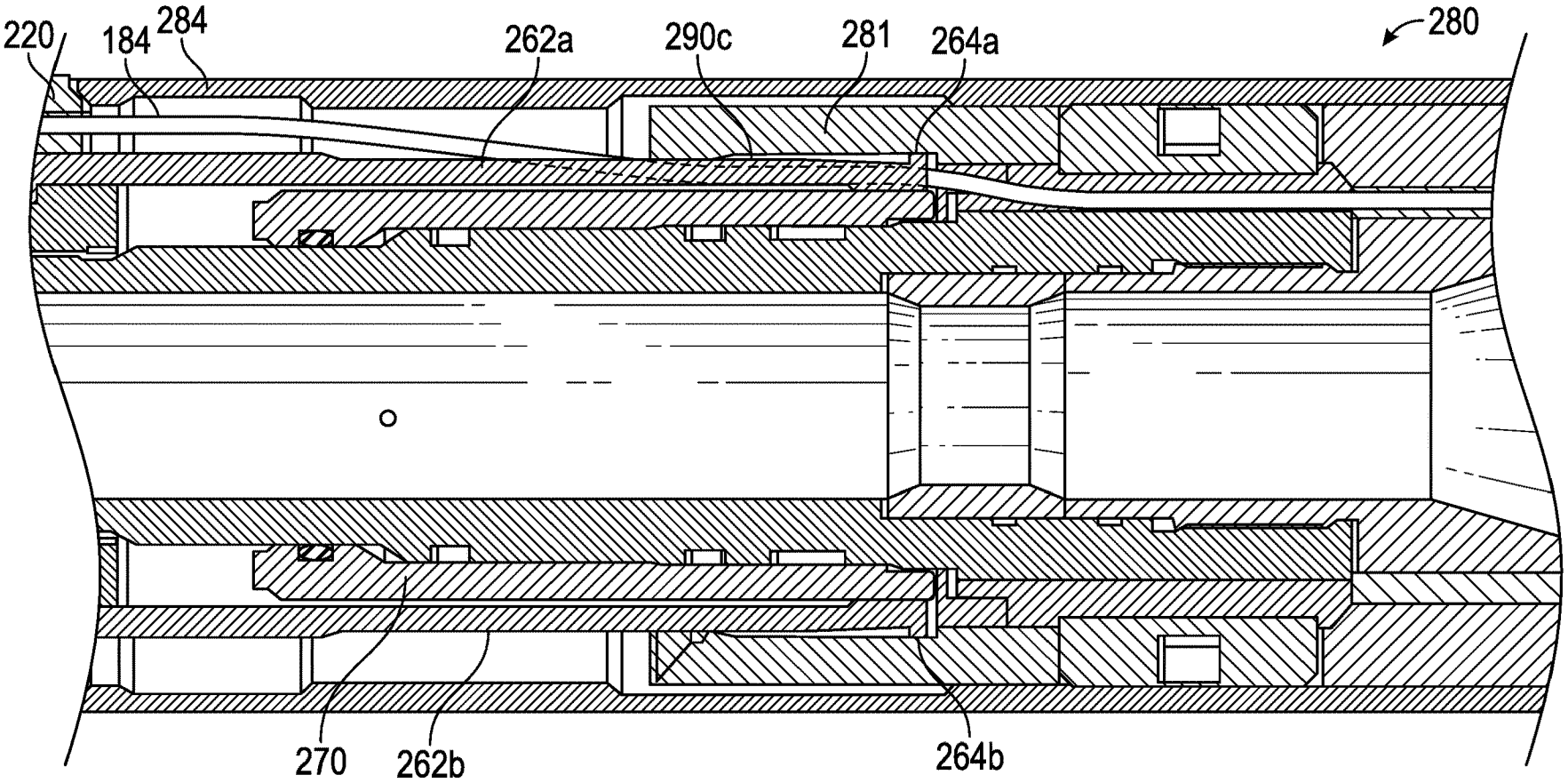
FIG. 2A shows an exploded view of a section of FIG. 2.

FIG. 2 shows an exemplary embodiment of a packer setting tool 200 configured to set a packer 280. FIG. 2A shows an exploded view of a section of FIG. 2. Referring now to FIGS. 2 and 2A, in one aspect, the packer setting tool 200 may be utilized as the packer setting tool 156 for setting the upper packer 125*m* shown in system 100 of FIG. 1. The packer setting tool 200 includes an upper connection 201 that connects the packer setting tool 200 to the interface sub 154 (FIG. 1) and a lower connection 202 that connects the packer setting tool 200 to a connection pipe 214 downhole of the packer setting tool 200. The packer setting tool 200 includes a flow through pipe 210 that provides a fluid passage 212 between the inner string (160, FIG. 1) and the surface. The packer setting tool 200 includes a connection device 260 that may include a number of spaced connection members, such as fingers 262*a*, 262*b*, etc., each such finger having a connection end, such as dogs 264*a*, 264*b*, which connect to or engage with a packer member 281. Spacing between adjacent fingers may be utilized to run the communication link 184, FIG. 1 as described later. The packer setting tool 200 further includes a device 270 that enables the packer setting tool 200 to disengage from the packer 280 after the packer has been set. The packer setting tool 200 further includes a piston 230 outside the flow through pipe 210 and a shroud 222 over the piston 230. The packer setting tool 200 also includes a movable outer sleeve 220 coupled to the piston 230. Packer 280 further includes a movable packer setting member 284, which member when moved causes the packer setting elements 282 to extend and engage with the casing (104, FIG. 1). To set the packer 280 against the casing, fluid under pressure is supplied to the piston 230, which moves the piston 230 downhole (to the right in FIG. 2). The piston 230 moves the outer sleeve 220 to the right, which moves the packer setting member 284 to the right to set the packer elements 282 against the casing (104, FIG. 1). In one aspect, the communication link 184 may be routed or placed under the shroud 222 and over the piston and over a part of the outer sleeve 220, as shown by label 290*a* The communication link 184 is then run through a bore 221 in the outer sleeve 220 as shown by label 290*b* and then between fingers 262*a*, 262*b* as shown by label 290*c* and then outside 214*a* of the connection pipe 214 and below the packer 280, as shown by label 290*c*. The communication link 184 then continues to run along the outside of the tubing 158, as shown by label 290*d*. The communication link 184 may be secured to the tubing 158 by any suitable mechanism, including but not limited to, clamps. Routing the communication link 184 through the outer sleeve 220 and the connection device 260 of the packer setting tool 200 and then between the ID of the packer 280 and the inner string as described herein enables the communication link 184 to pass from a location above the packer setting tool 200 to a location below the packer setting tool 200 without being exposed to high velocity frac slurry.

Figure 3:
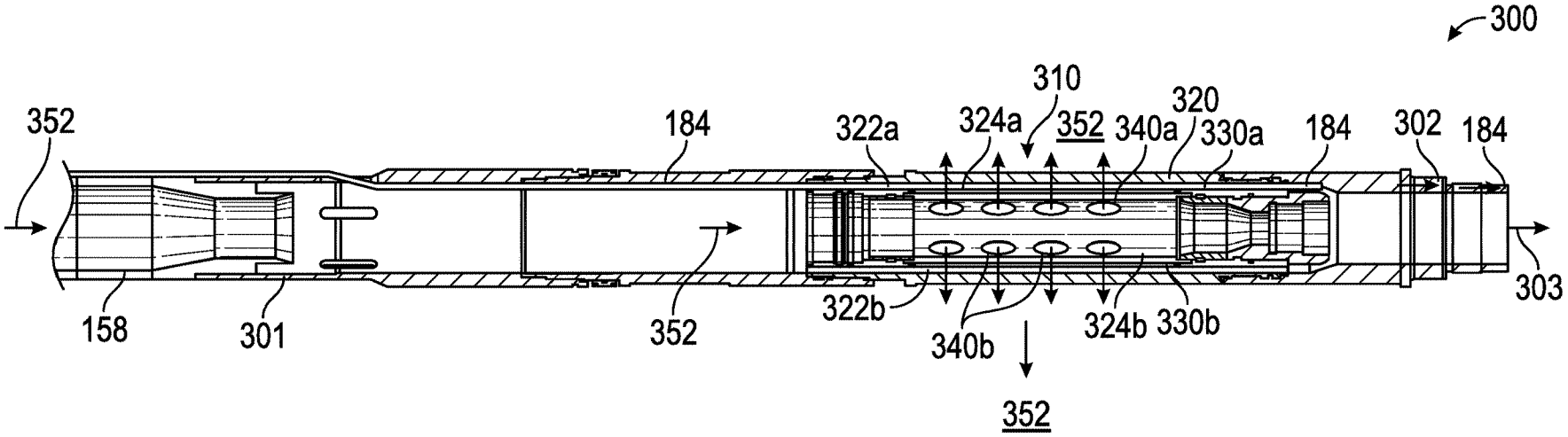
FIG. 3 shows certain details of an exemplary cross-over tool shown in FIG. 1 with the routing of the control line there through, according to one non-limiting embodiment of the disclosure.

FIG. 3 shows certain details of an exemplary cross-over tool 300 with the routing of the communication link 184 therethrough, according to one non-limiting embodiment of the disclosure. The cross-over tool 300 has an upper connection 301 that connects the cross-over tool to the pipe 158 and a lower connection 302 that connects the cross-over tool to a section 303 of the service tool 150 below the cross-over tool 300. The cross-over tool 300 includes a cross-over assembly 310 for supplying a treatment fluid 352 to a production zone, as described in reference to FIG. 1. The treatment fluid 352 may be any suitable fluid for performing a treatment operation, including, but not limited to, a mixture of water or gel and a proppant, such as sand or manufactured proppants. In one non-limiting embodiment, the cross-over assembly 310 includes a housing 320 that includes a number of through holes 322*a*, 322*b*, etc., along the length of the body 320. The body 320 further includes a number of radially spaced fluid inlets 324*a*, 324*b*, etc. (hidden in FIG. 3 but depicted in FIG. 4), etc. around the body 320. The body 320 further includes inserts 330*a*, 330*b*, etc. over the fluid inlets 324*a*, 324*b*, respectively, as shown in more detail in reference to FIG. 4. Each such insert includes a number of ports or fluid passages, such as ports 340*a* in insert 330*a*, ports 340*b* in insert 330*b*, etc. for supplying the treatment fluid 152 to the production zones, such as zones Z1-Zn shown on FIG. 1. Although the cross-over tool is shown to contain a number of elements, in aspects, it may only contain a frac port or another configuration know in the art.

Figure 4:
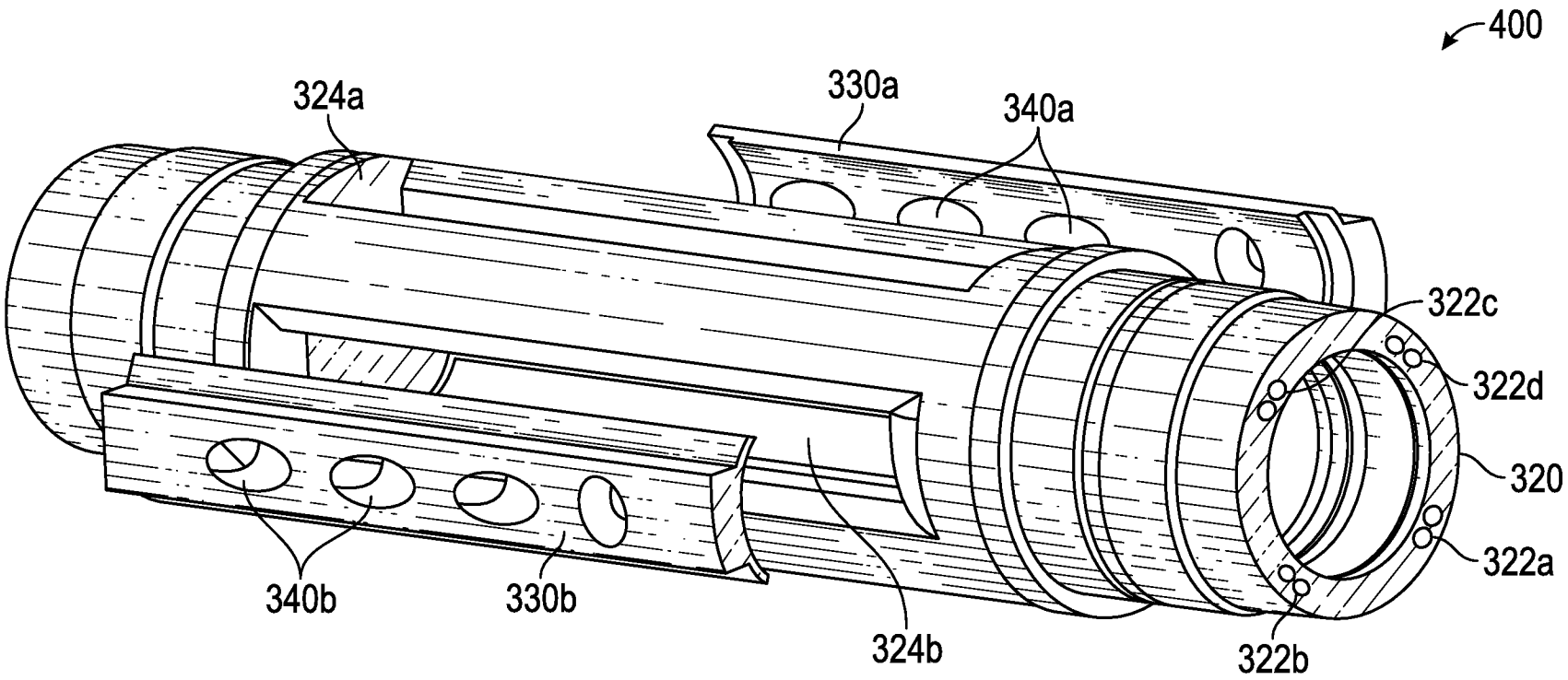
FIG. 4 shows a section of an exemplary cross-over tool shown FIG. 3 through which the control line shown in FIG. 3 may be routed.

FIG. 4 shows a section 400 of the cross-over assembly 310 shown in FIG. 3. The section 400 includes the housing 320 with through holes 322*a*, 322*b*, 322*c* and 322*d* drilled through the housing 320. The section 400 includes a number of fluid inlets 324*a*, 324*b*, etc., wherein inlet 324*a* is configured to be covered by insert 330*a*, inlet 324*b* by 333*b*, etc., and wherein insert 330*a* includes ports 340*a* and insert 330*b* includes ports 340*b*, etc.

Referring to FIGS. 3 and 4, in one aspect, the communication link 184 may be run through one or more holes, such as through holes 322*a*, 332*b*, etc. of the cross-over assembly 310. FIG. 3 shows communication link 184 running or passing through hole 322*a* from above the cross-over tool to below the cross-over tool. During a fracing operation, the treatment fluid 158, which can be extremely abrasive due to the high velocity and presence of proppant and other chemicals, such as acids, passes through the ports 340*a*, 340*b*, etc. under high pressure and can damage control lines, such as communication link 184. Routing the communication link 184 through passages 322*a*, 322*b*, prevents the communication link from coming in direct contact with the flow of the treatment fluid 352 through the cross-over tool 300.

Figure 5:
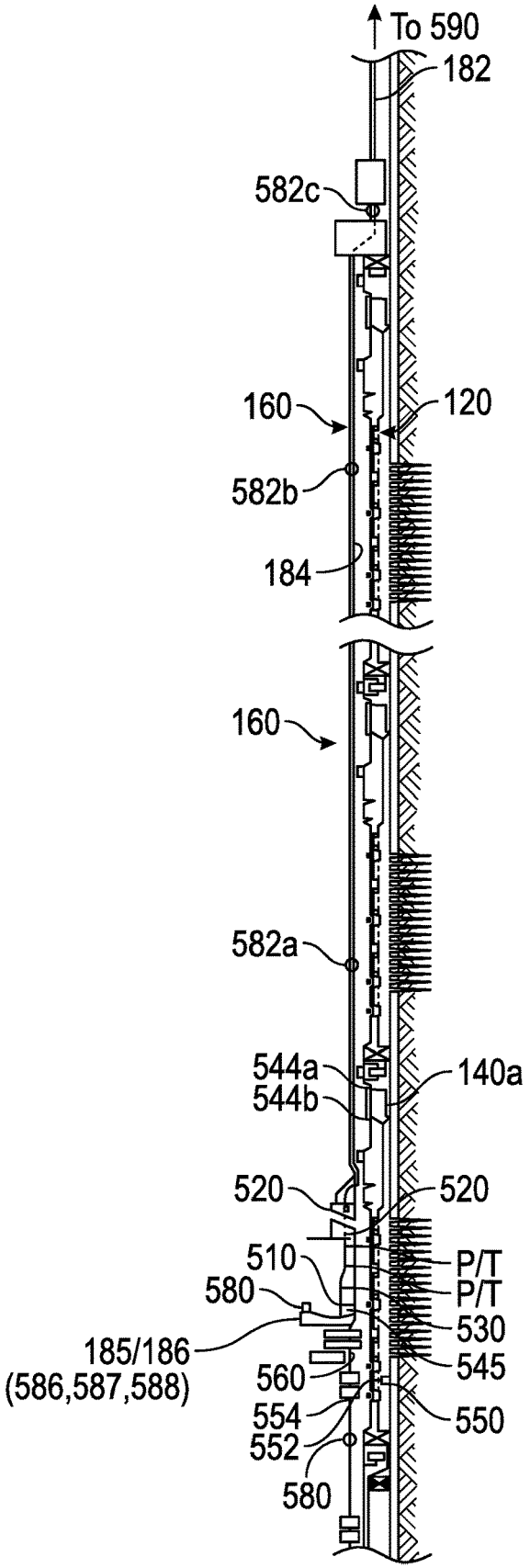
FIG. 5 shows placement of certain sensors in the system of FIG. 1 for determining certain parameters of interest in real time relating to downhole operations.

FIG. 5 shows placement of exemplary sensors in system 100 for determining various parameters of interest during a treatment operation. The parameters of interest may include, but, are not limited to, weight or load on a device in the inner string 160, tension on a device in the inner string 160, a location in the inner string or the outer string, location temperature at one or more locations and/or a temperature profile, pressures at one or more locations and/or a pressure profile, micro-seismic signals produced by the flow of a treatment fluid into the formation and/or cracking of the formation during a fracing operation, one or more flow rates of the fluid, and opening or closing of a device, such a sleeve valve. In one non-limiting embodiment, the system 100 may include on the inner string one or more weight and tension sensors 510, one or more pressure and temperature sensors P/T to determine the pressures and temperatures in the wellbore, one or more flow sensors 520 for determining the flow of a fluid, such as the flow of the treatment fluid 152 at one or more locations in the wellbore, and micro-seismic sensors 530, such acoustic sensors, for determining sound wave during a fracing operation to determine the effectiveness of the fracing operation. In another aspect, tags 544*a*, 544*b*, etc., such as magnetic tags, may be placed spaced apart on or proximate to a moving member, such as a sleeve of a sliding sleeve valve 140*a* for determining the movement of the sleeve and to ensure that the valve 140*a* has been correctly opened or closed. Tags, such as tags 544*a*, 544*b* also may be utilized to locate devices in the outer string 120 and/or to position a device, such as the set down tool 170, in the inner string 160 at a selected location inside the outer string 120. One or more tag detection sensors, such as sensors 545, may be placed in the inner string to detect the presence of the tags in the outer string 120. The tags may be of any suitable type, including, but not limited to, radiation tags, acoustic tags, electrical or resistive tags, and any other tags known in the art. Tags may also be utilized to locate other positions on the outer string 120 for any other purpose, including, but not limited to, use by the opening tool 162, closing tool 164, reverse valve 166 and the like. In another aspect, one or more suitable sensors, such as sensor 550 may be placed on the outside of the outer string 120 and a transmitter 552 may be placed on the inside of outer string 120. The sensor may include a battery for power and transmits signals to a receiver 554 in the inner string 160. Power to the control circuit 185 may be provided via a conductor in the communication link 184 by batteries 186 in the control circuit 185.

Still referring to FIG. 5, the sensors 520, 530, 544*a*, 544*b*, 550, etc. in the system 100 provide signals corresponding to their selected parameters of interest to the control circuit 185. In one aspect, the control circuit 185 may preprocess the received signals, such as pre-amplifying and digitizing the received signals, and transmit the digitized signals via the control line to a surface controller 590 (such as a computer or computer-based system) for further processing and for providing real-time information to the operator for taking actions as necessary. In another aspect, the control circuit 185 may include a processor, such as a microprocessor 586, a memory device 587, such as a solid state memory and programmed instruction 588 accessible to the processor 586 for executing instructions contained in the programs 588. The processor 586 may also be configured to receive signals from the surface controller 590, process the signals from the downhole sensors and transmit information as directed by the surface controller. Although the embodiment of FIG. 5 is described in reference to a wire-type links (which for example may include electric conductor(s) or a fiber optic link(s)) run in or along the inner string 160, other links, including acoustic links, may also be utilized for the purposes of this disclosure. For example, an acoustic link may include a transceiver 580 that receives signals from the control circuit 185 and transmits such signals via the inner string 160 to the surface. For long distances, repeaters 582*a*, 582*b*, 582*c*, etc., may be placed in the inner string 160 to receive, amplify, condition and retransmit the signals to the next repeater or the surface as the case may be. Thus, in one aspect, the disclosure provides real-time two-way communication between a surface location and one or more locations in a wellbore via the inner string 160.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a service tool coupled to a bottom end of a tubular, the service tool including:

a pipe connected to the tubular; and a cross-over assembly at the bottom end of the pipe, the cross-over assembly having a housing having a body defining an inside of the cross-over assembly from an outside of the cross-over assembly and a fluid flow passage through the body for supplying a fluid under pressure from the inside of the cross-over assembly to the outside of the cross-over assembly, the cross-over assembly having through passages through the body for providing an acoustic communication link between an acoustic transceiver downhole of the cross-over tool and a surface location.

2. The apparatus of claim 1, wherein the acoustic communication link extends from the cross-over assembly to a location in the service tool uphole of the cross-over assembly and wherein the acoustic communication link is coupled to another communication link in the tubular to provide communication between the service tool and the surface location.

3. The apparatus of claim 1, wherein the service assembly includes a control circuit.

4. The apparatus of claim 3, wherein the service tool includes at least one sensor below the cross-over tool that provides measurements relating a parameter of interest and wherein the acoustic communication link transmits signals from the sensor to the control circuit.

5. The apparatus of claim 4, wherein the parameter of interest is selected from a group consisting of: a location in an outer string; pressure; temperature; weight; tension; flow rate; fluid density; imaging; fluid composition; chemical composition; effectiveness of a fracturing operation; opening of a valve; and closing of the valve.

6. The apparatus of claim 4 further comprising an outer string, and wherein the service tool is deployed inside the outer string.

7. The apparatus of claim 6, wherein the at least one sensor is deployed in the outer string.

8. The apparatus of claim 1, wherein the tubular is a wired pipe.

9. The apparatus of claim 1, further comprising an acoustic transmission device below the service tool for transmitting an acoustic signal through the cross-over assembly via the through passages.

10. The apparatus of claim 1 further comprising:

a packer setting tool that includes a moveable outer member that sets a packer and a shroud on an outside portion of the packer.

11. A method of performing an operation in a wellbore, comprising:

deploying a service tool inside an outer string in the wellbore, wherein the service tool includes: a pipe connected to a bottom end of a tubular, and a cross-over assembly at a bottom end of the pipe, the cross-over assembly having a housing having a body defining an inside of the cross-over assembly from an outside of the cross-over assembly and a fluid flow passage through the assembly for supplying a fluid under pressure from the inside of the cross-over assembly to the outside of the cross-over assembly, the cross-over assembly having through passages extending through the body along a length of the body for providing an acoustic communication link between an acoustic transceiver downhole of the cross-over tool and a surface location;

supplying a treatment fluid in the wellbore via the fluid flow passage to perform a treatment operation; and transmitting, from the acoustic transceiver, an acoustic signal though the cross-over assembly via the acoustic communication link, through the pipe and to a controller, the acoustic signal relating to a parameter of interest of the treatment operation.

12. The method of claim 11 further comprising;

providing at least one sensor in one of the service tool and the outer string below the cross-over assembly for providing information about the parameter of interest; and determining the parameter of interest from the information provided by the at least one sensor in real time.

13. The method of claim 12 further comprising taking an action relating to the operation in response to information provided by the at least one sensor.

14. The method of claim 11, wherein the parameter of interest is selected from a group consisting of: a location in the outer string, pressure, temperature; weight; tension; flow rate; fluid density; imaging; fluid composition; chemical composition; effectiveness of a fracturing operation; opening of a valve; closing of a valve; an acoustic property; and an optical property.

15. The method of claim 11, wherein the communication link includes an upper section and a lower section and wherein the method further comprises running the upper section of the communication link through a jointed pipe, wherein the communication link through the jointed pipe is an acoustic communication link.

16. The method of claim 11, wherein the cross-over assembly further comprising one of an electric line, a fiber optic line or a combination thereof that runs from a location below the cross-over assembly to a location above the cross-over assembly via a through hole in the cross-over tool.

17. The method of claim 11, further comprising transmitting the acoustic signal from a transceiver below the cross-over assembly through the housing.

* * * * *